US006405169B1

(12) United States Patent
Kondo et al.

(10) Patent No.: US 6,405,169 B1
(45) Date of Patent: Jun. 11, 2002

(54) SPEECH SYNTHESIS APPARATUS

(75) Inventors: Reishi Kondo; Yukio Mitome, both of Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/325,544

(22) Filed: Jun. 4, 1999

(30) Foreign Application Priority Data

Jun. 5, 1998 (JP) ..... 10-157021

(51) Int. Cl.[7] ..... G10L 13/00

(52) U.S. Cl. ..... 704/258; 704/260

(58) Field of Search ..... 704/258, 260, 704/266, 267, 268, 269

(56) References Cited

U.S. PATENT DOCUMENTS

| | | | | | |
|---|---|---|---|---|---|
| 3,828,132 | A | * | 8/1974 | Flanagan et al. | 704/268 |
| 4,833,718 | A | * | 5/1989 | Sprague | 704/260 |
| 5,832,434 | A | * | 11/1998 | Meredith | 704/260 |
| 5,940,797 | A | * | 8/1999 | Abe | 704/260 |
| 6,035,272 | A | * | 3/2000 | Mishimura et al. | 704/258 |
| 6,101,470 | A | * | 8/2000 | Eide et al. | 704/260 |
| 6,109,923 | A | * | 8/2000 | Rothenberg | 704/200 |

FOREIGN PATENT DOCUMENTS

| | | |
|---|---|---|
| JP | 63-15297 | 1/1988 |
| JP | 4-53998 | 2/1992 |
| JP | 4-298794 | 10/1992 |
| JP | 6-161490 | 6/1994 |
| JP | 7-140996 | 6/1995 |

OTHER PUBLICATIONS

Furui, "Digital Speech Processing", Sep. 25, 1985.
"Speech Synthesis Software for a Personal Computer", Collection of Papers of the 47$^{th}$ National Meeting of the Information Processing Society of Japan, 1993.

* cited by examiner

*Primary Examiner*—William Korzuch
*Assistant Examiner*—Martin Lerner
(74) *Attorney, Agent, or Firm*—Whitham, Curtis & Christofferson P.C.

(57) ABSTRACT

The invention provides a speech synthesis apparatus which can produce synthetic speech of a high quality with reduced distortion. To this end, upon production of synthetic speech based on prosodic information and phonological unit information, the prosodic information is modified using the phonological unit information, and duration length information and pitch pattern information of phonological units of the prosodic information and the phonological unit information are modified with each other. The speech synthesis apparatus includes a prosodic pattern production section for receiving utterance contents as an input thereto and producing a prosodic pattern, a phonological unit selection section for selecting phonological units based on the prosodic pattern, a prosody modification control section for searching the phonological unit information selected by the phonological unit selection section for a location for which modification to the prosodic pattern is required and outputting information of the location for the modification and contents of the modification, a prosody modification section for modifying the prosodic pattern based on the information of the location for the modification and the contents of the modification outputted from the prosody modification control section, and a waveform production section for producing synthetic speech based on the phonological unit information and the prosodic information modified by the prosody modification section using a phonological unit database.

1 Claim, 11 Drawing Sheets

FIG.2

| UTTERED CONTENTS | a | i | s | a | ts | u |
|---|---|---|---|---|---|---|
| SELECTED VOCAL SOUND | 1 | 81 | 236 | 2 | 56 | 992 |

FIG.3

| NUMBER | PHONO-LOGICAL UNIT SYMBOL | AVERAGE PITCH FREQUENCY UPON SOUND COLLECTION | DURATION LENGTH UPON SOUND COLLECTION | ACCENT ENVIRONMENT UPON SOUND COLLECTION |
|---|---|---|---|---|
| 1 | a | 150Hz | 80msec | SECOND MORA OF 4-MORA 3 TYPE WORD |
| 2 | a | 182Hz | 64msec | THIRD MORA OF 6-MORA 3 TYPE WORD |
| 3 | i | 147Hz | 72msec | FOURTH MORA OF 4-MORA 3 TYPE WORD |
| ⋮ | ⋮ | ⋮ | ⋮ | ⋮ |
| 1876 | y | 156Hz | 96msec | SECOND MORA OF 2-MORA 1 TYPE WORD |

FIG.5

| RULE NUMBER | CONDITION | ACTION |
|---|---|---|
| 1 | DIFFERENCE BETWEEN PITCH TO BE PRODUCED AND PITCH UPON SOUND COLLECTION REGARDING VOICED SHORT VOWEL (a, i, u, e, o) BE WITHIN 5 Hz | PITCH FREQUENCY OF PERTAINING VOWEL BE MODIFIED TO PITCH FREQUENCY UPON SOUND COLLECTION |
| 2 | DURATION LENGTH TO BE PRODUCED FOR VOICELESS FRICTIONAL SOUND (s, sh) BE LONGER THAN 0.9 TIMES BUT SHORTER THAN 1.2 TIMES THE DURATION LENGTH UPON SOUND COLLECTION | DURATION LENGTH OF PERTAINING FRICTIONAL SOUND BE MODIFIED TO DURATION LENGTH UPON SOUND COLLECTION, & TIME ADDED IN MODIFICATION BE SUBTRACTED FROM DURATION LENGTH OF PERTAINING VOWEL |
| ⋮ | ⋮ | ⋮ |

SPEECH SYNTHESIS APPARATUS

BACKGROUND OF THE INVENTION

1. Field of the Invention

The present invention relates to a speech synthesis apparatus, and more particularly to an apparatus which performs speech synthesis by rule.

2. Description of the Related Art

Conventionally, in order to perform speech synthesis by rule, control parameters of synthetic speech are produced, and a speech waveform is produced based on the control parameters using an LSP (line spectrum pair) synthesis filter system, a formant synthesis system or a waveform editing system.

Control parameters of synthetic speech are roughly divided into phonological unit information and prosodic information. The phonological unit information is information regarding a list of phonological units used, and the prosodic information is information regarding a pitch pattern representative of intonation and accent and duration lengths representative of rhythm.

For production of phonological unit information and prosodic information, a method is conventionally known and disclosed, for example, in Furui, "Digital Speech processing", p.146, FIGS. 7 and 6 (document 1) wherein phonological unit information and prosodic information are produced separately from each other.

Also another method is known and disclosed in Takahashi et al., "Speech Synthesis Software for a Personal Computer", Collection of Papers of the 47th National Meeting of the Information Processing Society of Japan, pages 2-377 to 2-378 (document 2) wherein prosodic information is produced first, and then phonological unit information is produced based on the prosodic information. In the method, upon production of the prosodic information, duration lengths are produced first, and then a pitch pattern is produced. However, also an alternative method is known wherein duration lengths and a pitch pattern information are produced independently of each other.

Further, as a method of improving the quality of synthetic speech after prosodic information and phonological unit information are produced, a method is proposed, for example, in Japanese Patent Laid-Open Application No. Hei 4-053998 wherein a signal for improving the quality of speech is generated based on phonological unit parameters.

Conventionally, for control parameters to be used for speech synthesis by rule, meta information such as phonemic representations or devocalization regarding phonological units is used to produce prosodic information, but information of phonological units actually used for synthesis is not used.

Here, for example, in a speech synthesis apparatus which produces a speech waveform using a waveform concatenation method, for each of phonological units actually selected, the time length or the pitch frequency of the original speech is different.

Consequently, there is a problem in that a phonological unit actually used for synthesis is sometimes varied unnecessarily from its phonological unit as collected and this sometimes gives rise to a distortion of the sound on the sense of hearing.

SUMMARY OF THE INVENTION

It is an object of the present invention to provide a speech synthesis apparatus which reduces a distortion of synthetic speech.

It is another object of the present invention to provide a speech synthesis apparatus which can produce synthetic speech of a high quality.

In order to attain the objects described above, according to the present invention, upon production of synthetic speech based on prosodic information and phonological unit information, the prosodic information is modified using the phonological unit information. Specifically, duration length information and pitch pattern information and the phonological unit information are modified with each other.

In particular, according to an aspect of the present invention, there is provided a speech synthesis apparatus, comprising prosodic pattern production means for producing a prosodic pattern, phonological unit selection means for selecting phonological units based on the prosodic pattern produced by the prosodic pattern production means, and means for modifying the prosodic pattern based on the selected phonological units.

The speech synthesis apparatus is advantageous in that prosodic information can be modified based on phonological unit information, and consequently, synthetic speech with reduced distortion can be obtained taking environments of phonological units as collected into consideration.

According to another aspect of the present invention, there is provided a speech synthesis apparatus, comprising prosodic pattern production means for producing a prosodic pattern, phonological unit selection means for selecting phonological units based on the prosodic pattern produced by the prosodic pattern production means, and means for feeding back the phonological units selected by the phonological unit selection means to the prosodic pattern production means so that the prosodic pattern and the selected phonological units are modified repetitively.

The speech synthesis apparatus is advantageous in that, since phonological unit information is fed back to repetitively perform modification to it, synthetic speech with further reduced distortion can be obtained.

According to a further aspect of the present invention, there is provided a speech synthesis apparatus, comprising duration length production means for producing duration lengths of phonological units, pitch pattern production means for producing a pitch pattern based on the duration lengths produced by the duration length production means, and means for feeding back the pitch pattern to the duration length production means so that the phonological unit duration lengths are modified.

The speech synthesis apparatus is advantageous in that duration lengths of phonological units can be modified based on a pitch pattern and synthetic speech of a high quality can be produced.

According to a still further aspect of the present invention, there is provided a speech synthesis apparatus, comprising duration length production means for producing duration lengths of phonological units, pitch pattern production means for producing a pitch pattern, phonological unit selection means for selecting phonological units, first means for supplying the duration lengths produced by the duration length production means to the pitch pattern production means and the phonological unit selection means, second means for supplying the pitch pattern produced by the pitch pattern production means to the duration length production means and the phonological unit selection means, and third means for supplying the phonological units selected by the phonological unit selection means to the pitch pattern production means and the duration length production means, the duration lengths, the pitch pattern and the phonological units being modified by cooperative operations of the duration length production means, the pitch pattern production means and the phonological unit selection means.

The speech synthesis apparatus is advantageous in that modification to duration lengths and a pitch pattern of phonological units and phonological unit information can be performed by referring to them with each other and synthetic speech of a high quality can be produced.

According to a yet further aspect of the present invention, there is provided a speech synthesis apparatus, comprising duration length production means for producing duration lengths of phonological units, pitch pattern production means for producing a pitch pattern, phonological unit selection means for selecting phonological units, and control means for activating the duration length production means, the pitch pattern production means and the phonological unit selection means in this order and controlling the duration length production means, the pitch pattern production means and the phonological unit selection means so that at least one of the duration lengths produced by the duration length production means, the pitch pattern produced by the pitch pattern production means and the phonological units selected by the phonological unit selection means is modified by a corresponding one of the duration length production means, the pitch pattern production means and the phonological unit selection means.

The speech synthesis apparatus is advantageous in that, since modification to duration lengths and a pitch pattern of phonological units and phonological unit information is determined not independently of each other but collectively by the single control means, synthetic speech of a high quality can be produced and the amount of calculation can be reduced.

The speech synthesis apparatus may be constructed such that it further comprises a shared information storage section, and the duration length production means produces duration lengths based on information stored in the shared information storage section and writes the duration length into the shared information storage section, the pitch pattern production section produces a pitch pattern based on the information stored in the shared information storage section and writes the pitch pattern into the shared information storage section, and the phonological unit selection means selects phonological units based on the information stored in the shared information storage section and writes the phonological units into the shared information storage section.

The speech synthesis apparatus is advantageous in that, since information mutually relating to the pertaining means is shared by the pertaining means, reduction of the calculation time can be achieved.

The above and other objects, features and advantages of the present invention will become apparent from the following description and the appended claims, taken in conjunction with the accompanying drawings in which like parts or elements are denoted by like reference symbols.

BRIEF DESCRIPTION OF THE DRAWINGS

FIG. 2 is a table illustrating an example of phonological unit information to be selected in the speech synthesis apparatus of FIG. 1;

FIG. 3 is a table schematically illustrating contents of a phonological unit condition database used in the speech synthesis apparatus of FIG. 1;

FIG. 5 is a table illustrating an example of phonological unit modification rules used in the speech synthesis apparatus of FIG. 1;

DESCRIPTION OF THE PREFERRED EMBODIMENT

Before a preferred embodiment of the present invention is described, speech synthesis apparatus according to different aspects of the present invention are described in connection with elements of the preferred embodiment of the present invention described below.

Figure 1:
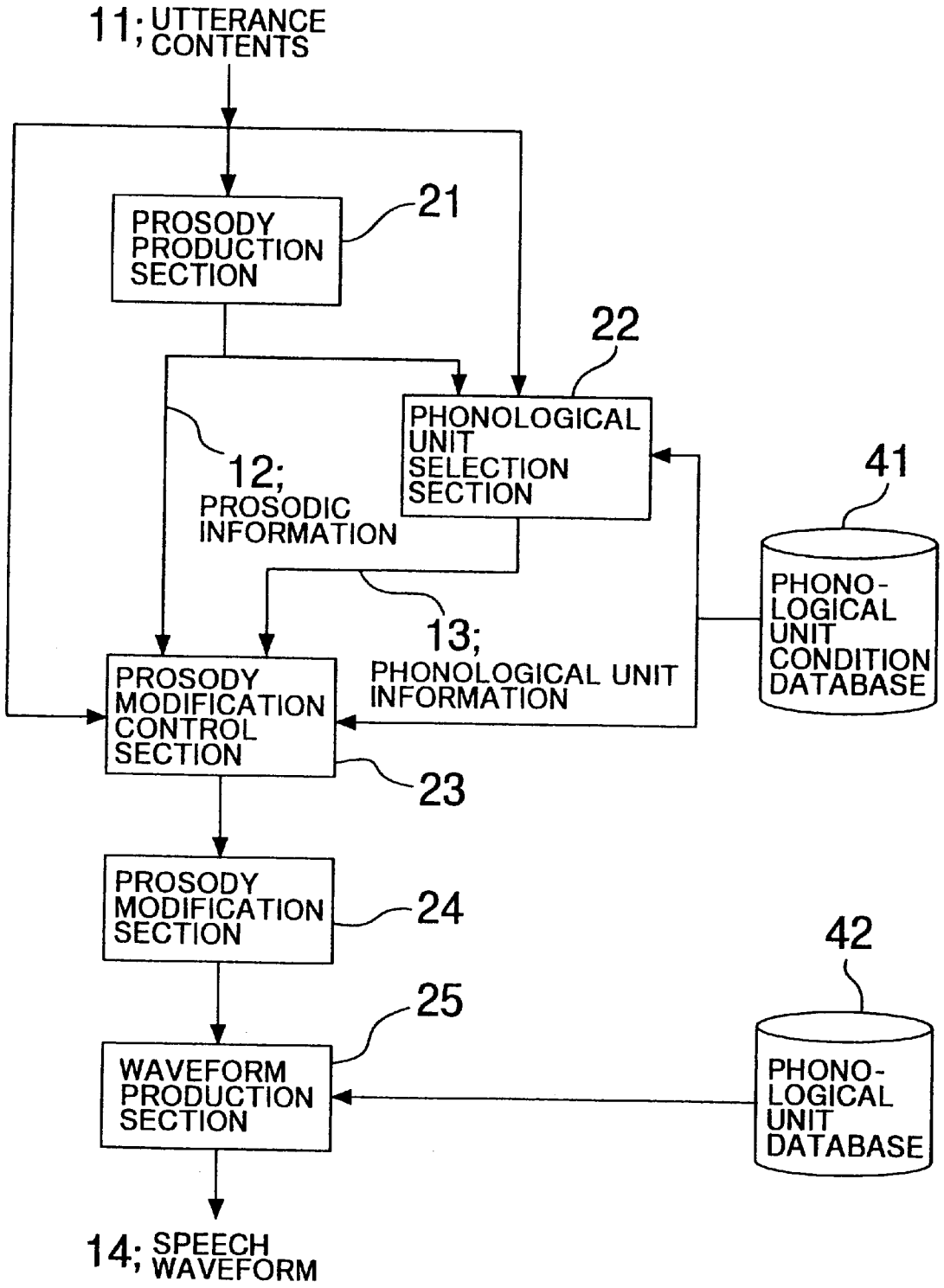
FIG. 1 is a block diagram showing a speech synthesis apparatus to which the present invention is applied.

A speech synthesis apparatus according to an aspect of the present invention includes a prosodic pattern production section (21 in FIG. 1) for receiving utterance contents such as a text and a phonetic symbol train to be uttered, index information representative of a particular utterance text and so forth as an input thereto and producing a prosodic pattern which includes one or more or all of an accent position, a pause position, a pitch pattern and a duration length, a phonological unit selection section (22 of FIG. 1) for selecting phonological units based on the prosodic pattern produced by the prosodic pattern production section, a prosody modification control section (23 of FIG. 1) for searching the phonological unit information selected by the phonological unit selection section for a location for which modification to the prosodic pattern is required and outputting information of the location for the modification and contents of the modification, a prosody modification section (24 of FIG. 1) for modifying the prosodic pattern based on the information of the location for the modification and the contents of the modification outputted from the prosody modification control section, and a waveform production section (25 of FIG. 1) for producing synthetic speech based on the phonological unit information and the prosodic information modified by the prosody modification section using a phonological unit database (42 of FIG. 1).

A speech synthesis apparatus according to another aspect of the present invention includes a prosodic pattern production section for producing a prosodic pattern, and a phonological unit selection section for selecting phonological units based on the prosodic pattern produced by the prosodic pattern production section (21 of FIG. 1), and feeds back contents of a location for modification regarding phonological units selected by the phonological unit selection section from a prosody modification control section (23 of FIG. 1) to the prosodic pattern production section so that the prosodic pattern and the selected phonological units are modified repetitively.

In the speech synthesis apparatus, the prosodic pattern production section for receiving utterance contents as an input thereto and producing a prosodic pattern based on the utterance contents includes a duration length production section (26 of FIG. 6) for producing duration lengths of phonological units and a pitch pattern production section (27 of FIG. 6) for producing a prosodic pattern based on the duration lengths produced by the duration length production section. Further, the phonological unit selection section (22 of FIG. 6) selects phonological units based on the prosodic pattern produced by the pitch pattern production section. The phonological unit modification control section (23 of FIG. 6) searches the phonological unit information selected by the phonological unit selection section for a location for which modification to the prosodic pattern produced by the pitch pattern production section is required and feeds back, when modification is required, information of contents of the modification to the duration length production section and/or the pitch pattern production section so that the duration lengths and the pitch pattern are modified by the duration length production section and the pitch pattern production section, respectively. Thus, the prosodic pattern and the selected phonological units are modified repetitively.

A speech synthesis apparatus according to a further aspect of the present invention includes a duration length production section (26 of FIG. 7) for producing duration lengths of phonological units, a pitch pattern production section (27 of FIG. 7) for producing a pitch pattern based on the duration lengths produced by the duration length production section, and a duration length modification control section (29 of FIG. 7) for feeding back the pitch pattern to the duration length production section so that the phonological unit duration lengths are modified. The speech synthesis apparatus further includes a duration length modification control section (29 of FIG. 7) for discriminating modification contents to the duration length information produced by the duration length production section (26 of FIG. 7), and a duration length modification section (30 of FIG. 7) for modifying the duration length information in accordance with the modification contents outputted from the duration length modification control section (29 of FIG. 7).

A speech synthesis apparatus according to a still further aspect of the present invention includes a duration length production section (26 of FIG. 9) for producing duration lengths of phonological units, a pitch pattern production section (27 of FIG. 9) for producing a pitch pattern, a phonological unit selection section (22 of FIG. 9) for selecting phonological units, a means (29 of FIG. 9) for supplying the duration lengths produced by the duration length production section (26 of FIG. 9) to the pitch pattern production section and the phonological unit selection section, another means (31 of FIG. 9) for supplying the pitch pattern produced by the pitch pattern production section to the duration length production section and the phonological unit selection section, and a further means (32 of FIG. 9) for supplying the phonological units selected by the phonological unit selection section to the pitch pattern production section and the duration length production section, the duration lengths, the pitch pattern and the phonological units being modified by cooperative operations of the duration length production section, the pitch pattern production section and the phonological unit selection section. More particularly, a duration length modification control section (29 of FIG. 9) determines modification contents to the duration lengths based on the utterance contents, the pitch pattern information from the pitch pattern production section (27 of FIG. 9) and the phonological unit information from the phonological unit selection section (22 of FIG. 9), and the duration length production section (26 of FIG. 9) produces duration length information in accordance with the thus determined modification contents. A pitch pattern modification control section (31 of FIG. 9) determines modification contents to the pitch pattern based on the utterance contents, the duration length information from the duration time production section (26 of FIG. 9) and the phonological unit information from the phonological unit selection section (22 of FIG. 9), and the pitch pattern production section (27 of FIG. 9) produces pitch pattern information in accordance with the thus determined modification contents. Further, a phonological unit modification control section (32 of FIG. 9) determines modification contents to the phonological units based on the uttered contents, the duration length information from the duration time production section (26 of FIG. 9) and the pitch pattern information from the pitch pattern production section (27 of FIG. 9), and the phonological unit selection section (22 of FIG. 9) produces phonological unit information in accordance with the thus determined modification contents.

Figure 11:
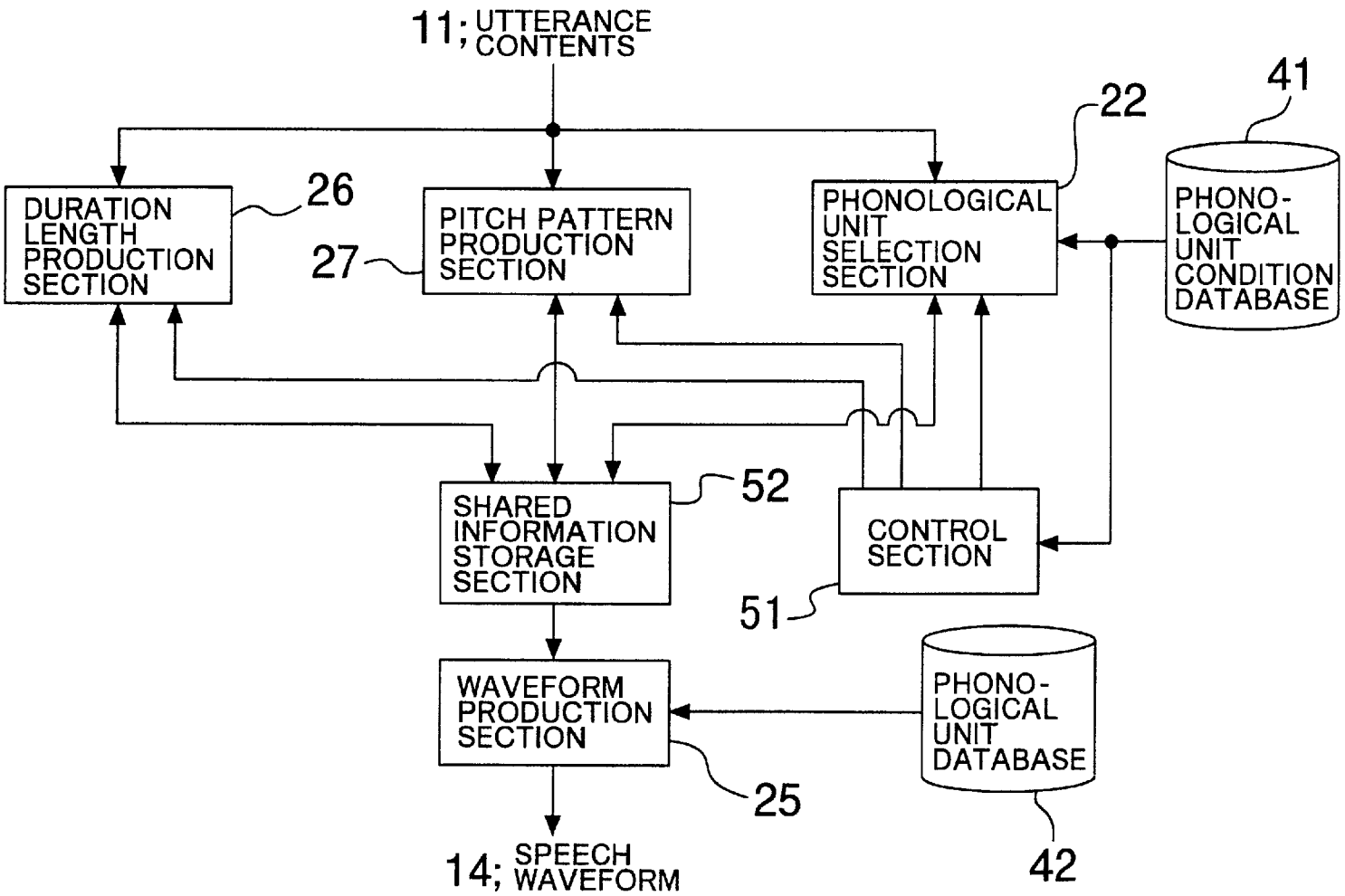

The speech synthesis apparatus may further include a shared information storage section (52 of FIG. 11). In this instance, the duration length production section (26 of FIG. 11) produces duration lengths based on information stored in the shared information storage section and writes the duration length into the shared information storage section. The pitch pattern production section (27 of FIG. 11) produces a pitch pattern based on the information stored in the shared storage section and writes the pitch pattern into the shared information storage section. Further, the phonological unit selection section (22 of FIG. 11) selects phonological units based on the information stored in the shared information storage section and writes the phonological units into the shared information storage section.

The speech synthesis apparatus may further include a shared information storage section (52 of FIG. 11). In this instance, the duration length production section (26 of FIG. 11) produces duration lengths based on information stored in the shared information storage section and writes the duration length into the shared information storage section. The pitch pattern production section (28 of FIG. 11) produces a pitch pattern based on the information stored in the shared information storage section and writes the pitch pattern into the shared information storage section. Further, the phonological unit selection section (22 of FIG. 11) selects phonological units based on the information stored in the shared information storage section and writes the phonological units into the shared information storage section.

Referring now to FIG. 1, there is shown a speech synthesis apparatus to which the present invention is applied. The speech synthesis apparatus shown includes a prosody production section 21, a phonological unit selection section 22, a prosody modification control section 23, a prosody modification section 24, a waveform production section 25, a phonological unit condition database 41 and a phonological unit database 42.

The prosody production section 21 receives contents 11 of utterance as an input thereto and produces prosodic information 12. The utterance contents 11 include a text and a phonetic symbol train to be uttered, index information representative of a particular utterance text and so forth. The prosodic information 12 includes one or more or all of an accent position, a pause position, a pitch pattern and a duration length.

The phonological unit selection section 22 receives the utterance contents 11 and the prosodic information produced by the prosody production section 21 as inputs thereto, selects a suitable phonological unit sequence from phonological units recorded in the phonological unit condition database 41 and determines the selected phonological unit sequence as phonological unit information 13.

The phonological unit information 13 may possibly be different significantly depending upon a method employed by the waveform production section 25. However, a train of indices representative of phonological units actually used as seen in FIG. 2 is used as the phonological unit information 13 here. FIG. 2 illustrates an example of an index train of phonological units selected by the phonological unit selection section 22 when the utterance contents are "aisatsu".

FIG. 3 illustrates contents of the phonological unit condition database 41 of the speech synthesis apparatus of FIG. 1. Referring to FIG. 3, in the phonological unit condition database 41, information regarding a symbol representative of a phonological unit, a pitch frequency of a speech as collected, a duration length and an accent position is recorded in advance for each phonological unit provided in the speech synthesis apparatus.

Referring back to FIG. 1, the prosody modification control section 23 searches the phonological unit information 13 selected by the phonological unit selection section 22 for a portion for which modification in prosody is required. Then, the prosody modification control section 23 sends information of the location for modification and contents of the modification to the prosody modification section 24, and the prosody modification section 24 modifies the prosodic information 12 from the prosody production section 21 based on the received information.

Figure 4:
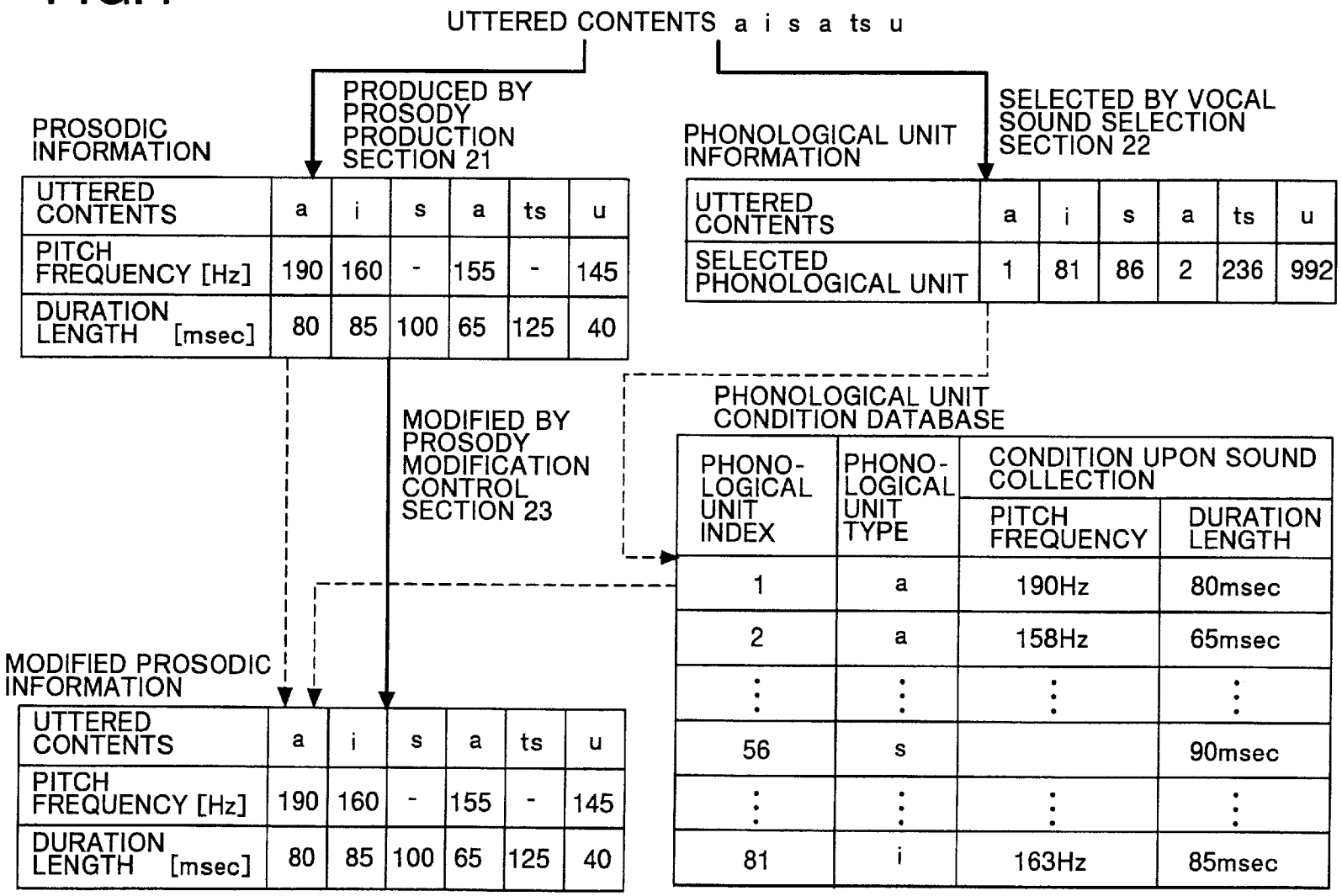
FIG. 4 is a diagrammatic view illustrating operation of a phonological unit modification section of the speech synthesis apparatus of FIG. 1.

The prosody modification control section 23 which discriminates whether or not modification in prosody is required determines whether modification to the prosodic information 12 is required in accordance with rules determined in advance. FIG. 4 illustrates operation of the prosody modification control section 23 of the speech synthesis apparatus of FIG. 1, and such operation of the prosody modification control section 23 is described below with reference to FIG. 4.

From FIG. 4, it can be seen that the utterance contents are "aisatsu", and with regard to the first phonological unit "a" of the utterance contents, the pitch frequency produced by the prosody production section 21 is 190 Hz and the duration length is 80 msec. Further, with regard to the same first phonological unit "a", the phonological unit index selected by the phonological unit selection section 22 is 1. Thus, by referring to the index 1 of the phonological unit condition database 41, it can be seen that the pitch frequency of the sound as collected is 190 Hz, and the duration length of the sound as collected is 80 msec. In this instance, since the conditions when the speech was collected and the conditions to be produced actually coincide with each other, no modification is performed.

With regard to the next phonological unit "i", the pitch frequency produced by the prosody production section 21 is 160 Hz, and the duration length is 85 msec. Since the phonological unit index selected by the phonological unit selection section 22 is 81, the pitch frequency of the sound as collected was 163 Hz and the duration length of the sound as collected was 85 msec. In this instance, since the duration lengths are equal to each other, no modification is required, but the pitch frequencies are different from each other.

FIG. 5 illustrates an example of the rules used by the prosody modification section 24 of the speech synthesis apparatus of FIG. 1. Each rule includes a rule number, a condition part and an action (if <condition> then <action> format), and if satisfaction of a condition is determined, then processing of the corresponding action is performed. Referring to FIG. 5, the pitch frequency mentioned above satisfies the condition part of the rule 1 (the difference between a pitch to be produced for a voiced short vowel (a, i, u, e, o) and the pitch of the sound as collected is within 5 Hz) and makes an object of modification (the action is to modify the pitch frequency to that of the collected sound), and consequently, the pitch frequency is modified to 163 Hz. Consequently, since the pitch frequency need not be transformed unnecessarily, the synthetic sound quality is improved.

Referring back to FIG. 4, with regard to the next phonological unit "s", since this phonological unit is a voiceless sound, the pitch frequency is not defined, and the duration length produced by the prosody production section 21 is 100 msec. And, since the phonological unit selected by the phonological unit selection section 22 is 56, the duration length of the sound as collected is 90 msec. This duration length satisfies the rule 2 of FIG. 5 and makes an object of modification, and consequently, the duration length is modified to 90 msec. Consequently, since the duration length need not be transformed unnecessarily, the synthetic sound quality is improved.

Referring back to FIG. 1, the waveform production section 25 produces synthetic speech based on the phonological unit information 13 and the prosodic information 12 modified by the prosody modification section 24 using the phonological unit database 42.

In the phonological unit database 42, speech element pieces for production of synthetic speech corresponding to the phonological unit condition database 41 are registered.

Figure 6:
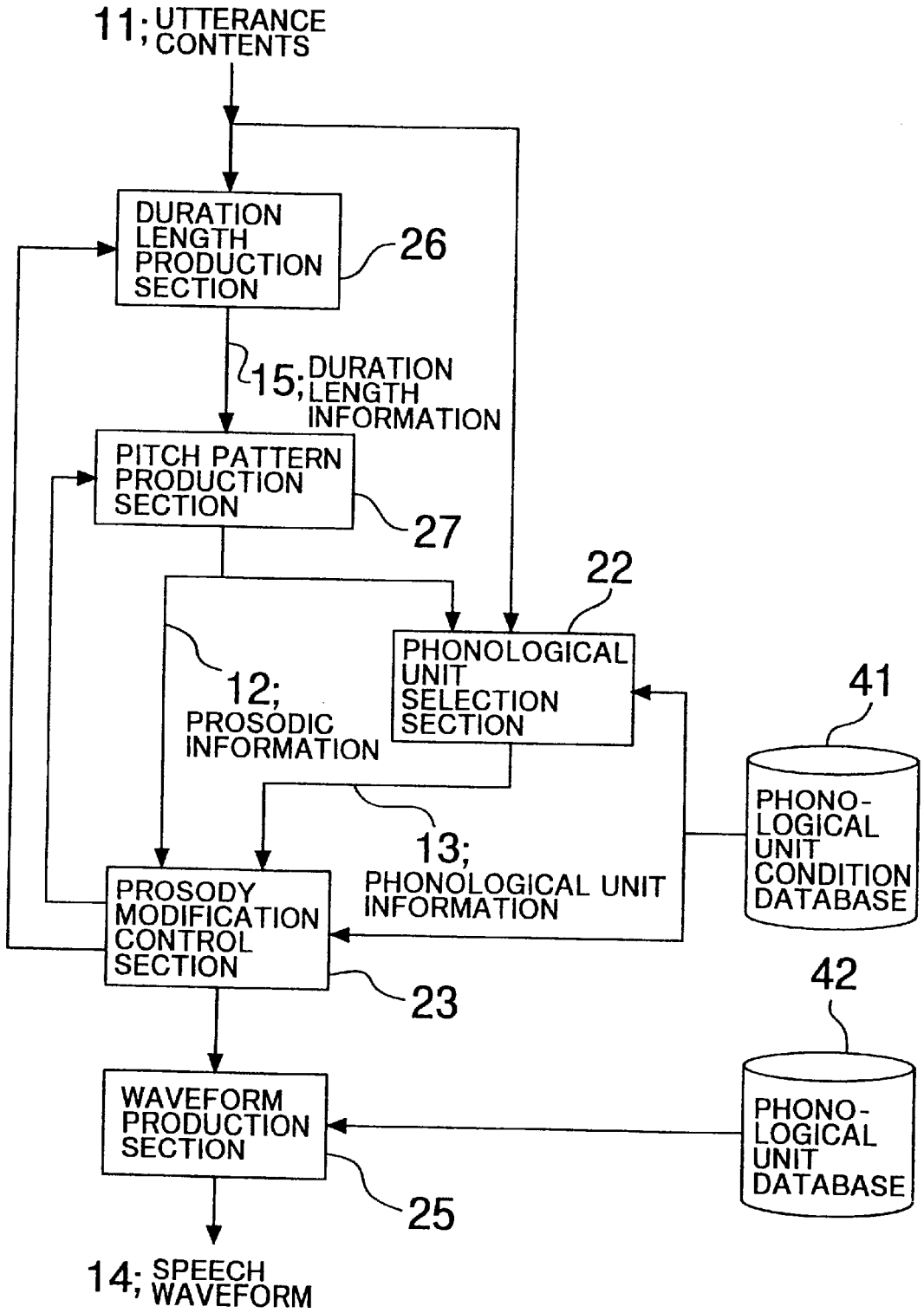
FIG. 6 is a block diagram of a modification to the speech synthesis apparatus of FIG. 1.

Referring now to FIG. 6, there is shown a modification to the speech synthesis apparatus described hereinabove with reference to FIG. 1. The modified speech synthesis apparatus is different from the speech synthesis apparatus of FIG. 1 in that it includes, in place of the prosody production section 21 described hereinabove, a duration length production section 26 and a pitch pattern production section 27 which successively produce duration length information 15 and pitch pattern information, respectively, to produce prosodic information 12.

The duration length production section 26 produces duration lengths for utterance contents 11 inputted thereto. At this time, however, if a duration length is designated for some phonological unit, then the duration length production section 26 uses the duration length to produce a duration length of the entire utterance contents 11.

The pitch pattern production section 27 produces a pitch pattern for the utterance contents 11 inputted thereto. However, if a pitch frequency is designated for some phonological unit, then the pitch pattern production section 27 uses the pitch frequency to produce a pitch pattern for the entire utterance contents 11.

The prosody modification control section 23 sends modification contents to phonological unit information determined in a similar manner as in the speech synthesis apparatus of FIG. 1 not to the prosody modification section 24 but to the duration length production section 26 and the pitch pattern production section 27 when necessary.

The duration length production section 26 re-produces, when the modification contents are sent thereto from the prosody modification control section 23, duration length information in accordance with the modification contents. Thereafter, the operations of the pitch pattern production section 27, phonological unit selection section 22 and prosody modification control section 23 described above are repeated.

The pitch pattern production section 27 re-produces, when the modification contents are set thereto from the prosody modification control section 23, pitch pattern information in accordance with the contents of modification. Thereafter, the operations of the phonological unit selection section 22 and the prosody modification control section 23 are repeated. If the necessity for modification is eliminated, then the prosody modification control section 23 sends the prosodic information 12 received from the pitch pattern production section 27 to the waveform production section 25.

The present modified speech synthesis apparatus performs, different from the speech synthesis apparatus of FIG. 1, feedback control, and to this end, discrimination of convergence is performed by the prosody modification control section 23. More particularly, the number of times of modification is counted, and if the number of times of modification exceeds a prescribed number determined in advance, then the prosody modification control section 23 determines that there remains no portion to be modified and sends the prosodic information 12 then to the waveform production section 25.

Figure 7:
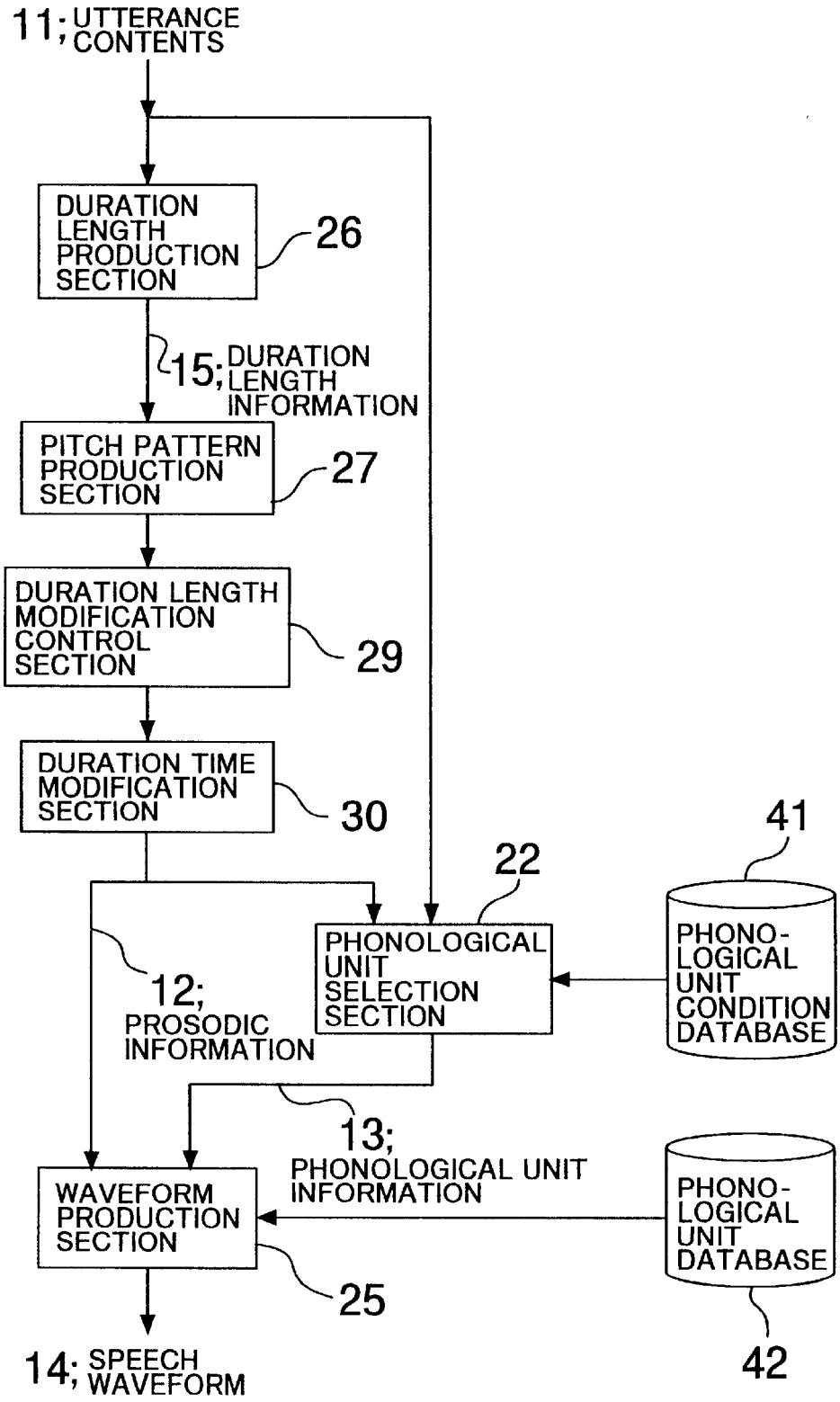
FIG. 7 is a block diagram of another modification to the speech synthesis apparatus of FIG. 1.

Referring now to FIG. 7, there is shown another modification to the speech synthesis apparatus described hereinabove with reference to FIG. 1. The present modified speech synthesis apparatus is different from the speech synthesis apparatus of FIG. 1 in that it includes, in place of the prosody production section 21, a duration length production section 26 and a pitch pattern production section 27 similarly as in the modified speech synthesis apparatus of FIG. 6, and further includes a duration length modification control section 29 for discriminating contents of modification to duration length information produced by the duration length production section 26, and a duration length modification section 30 for modifying the duration length information 15 in accordance with the modification contents outputted from the duration length modification control section 29.

Figure 8:
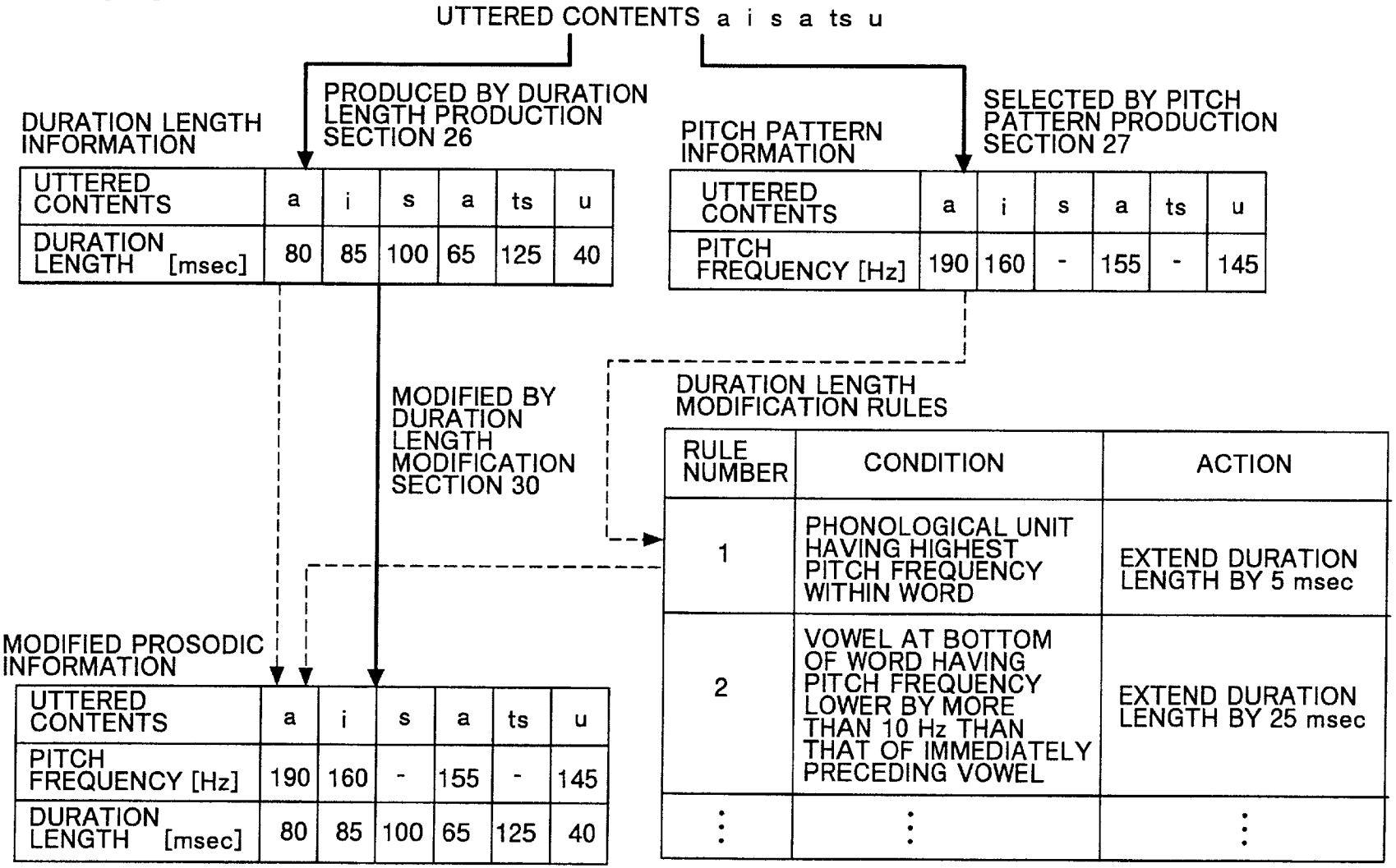
FIG. 8 is a diagrammatic view illustrating operation of a duration length modification control section of the modified speech synthesis apparatus of FIG. 7.

Operation of the duration length modification control section 29 of the present modified speech synthesis apparatus is described with reference to FIG. 8. With regard to the first phonological unit "a" of the utterance contents "a i s a ts u", the pitch frequency produced by the pitch pattern production section 27 is 190 Hz.

The duration length modification control section 29 has predetermined duration length modification rules (if then format) provided therein, and the pitch frequency of 190 Hz mentioned above corresponds to the rule 1. Therefore, the duration length for the phonological unit "a" is modified to 85 msec.

As regards the next phonological unit "i", the duration length modification control section 29 does not have a pertaining duration length modification rule and therefore is not subject to modification. All of the phonological units of the utterance contents 11 are checked to detect whether or not modification is required in this manner to determine modification contents to duration length information 15.

Figure 9:
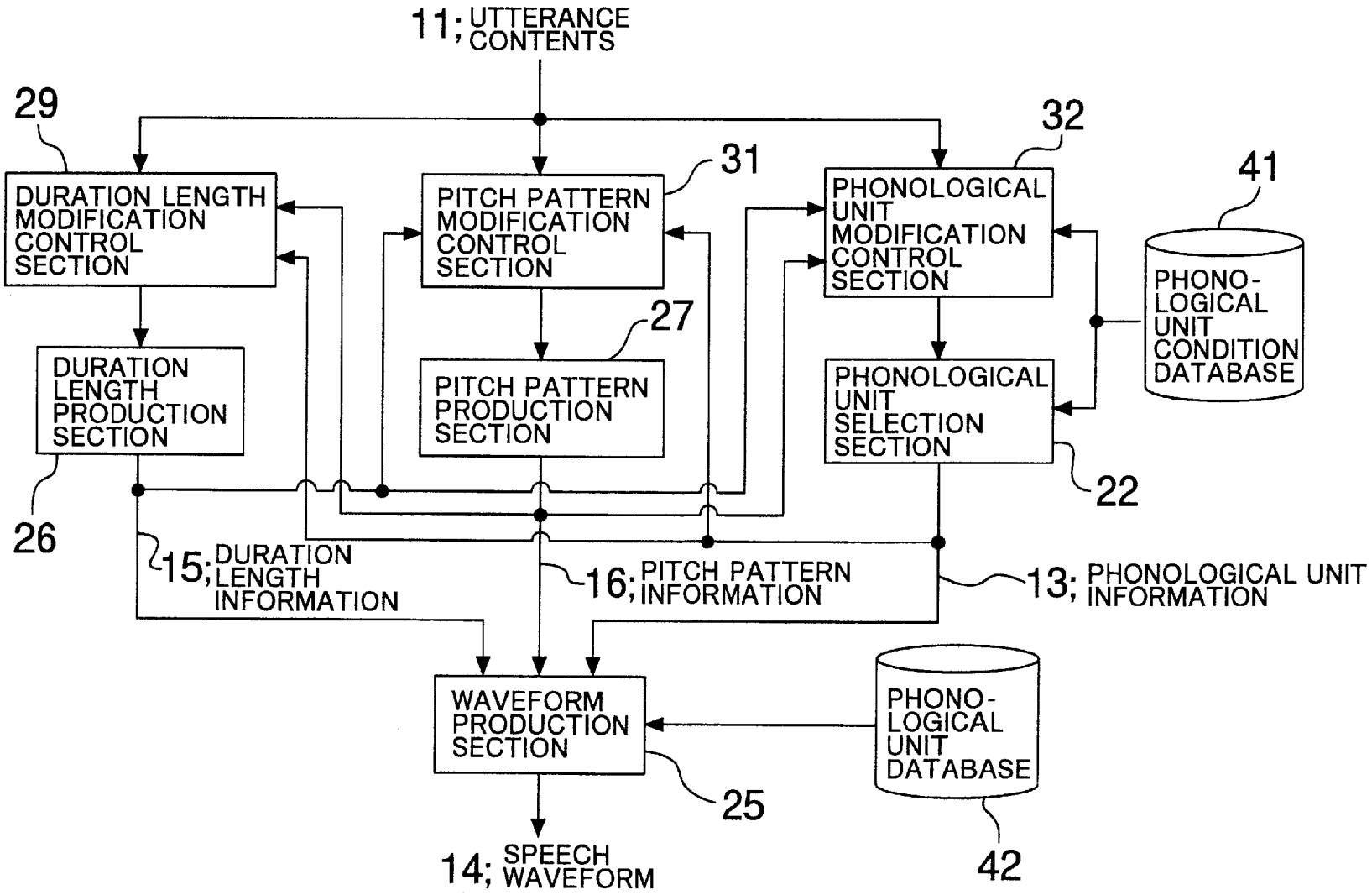
FIGS. 9 to 11 are block diagrams of different modifications to the speech synthesis apparatus of FIG. 1.

Referring now to FIG. 9, there is shown a further modification to the speech synthesis apparatus described hereinabove with reference to FIG. 1. The present modified speech synthesis apparatus is different from the speech synthesis apparatus of FIG. 1 in that it includes, in place of the prosody production section 21, a duration length production section 26 and a pitch pattern production section 27 similarly as in the speech synthesis apparatus of FIG. 6, and further includes a duration length modification control section 29, a pitch pattern modification control section 31 and a phonological unit modification control section 32. The duration length modification control section 29 determines modification contents to duration lengths based on utterance contents 11, pitch pattern information 16 and phonological unit information 13, and the duration length production section 26 produces duration length information 15 in accordance with the modification contents.

The pitch pattern modification control section 31 determines modification contents to a pitch pattern based on the utterance contents 11, duration length information 15 and phonological unit information 13, and the pitch pattern production section 27 produces pitch pattern information 16 in accordance with the thus determined modification contents.

The phonological unit modification control section 32 determines modification contents to phonological units based on the utterance contents 11, duration length information 15 and pitch pattern information 16, and the phonological unit selection section 22 produces phonological unit information 13 in accordance with the thus determined modification contents.

When the utterance contents 11 are first provided to the modified speech synthesis apparatus of FIG. 9, since the duration length information 15, pitch pattern information 16 and phonological unit information 13 are not produced as yet, the duration length modification control section 29 determines that no modification should be performed, and the duration length production section 26 produces duration lengths in accordance with the utterance contents 11.

Then, the pitch pattern modification control section 31 determines modification contents based on the duration length information 15 and the utterance contents 11 since the phonological unit information 13 is not produced as yet, and the pitch pattern production section 27 produces pitch pattern information 16 in accordance with the thus determined modification contents.

Thereafter, the phonological unit modification control section 32 determines modification contents based on the utterance contents 11, duration length information 15 and pitch pattern information 16, and the phonological unit selection section 22 produces phonological unit information based on the thus determined modification contents using the phonological unit condition database 41.

Thereafter, each time modification is performed successively, the duration length information 15, pitch pattern information 16 and phonological unit information 13 are updated, and the duration length modification control section 29, pitch pattern modification control section 31 and phonological unit modification control section 32 to which they are inputted, respectively, are activated to perform their respective operations.

Then, when updating of the duration length information 15, pitch pattern information 16 and phonological unit information 13 is not performed any more or when an end condition defined in advance is satisfied, the waveform production section 25 produces a speech waveform 14.

The end condition may be, for example, that the total number of updating times exceeds a value determined in advance.

Figure 10:
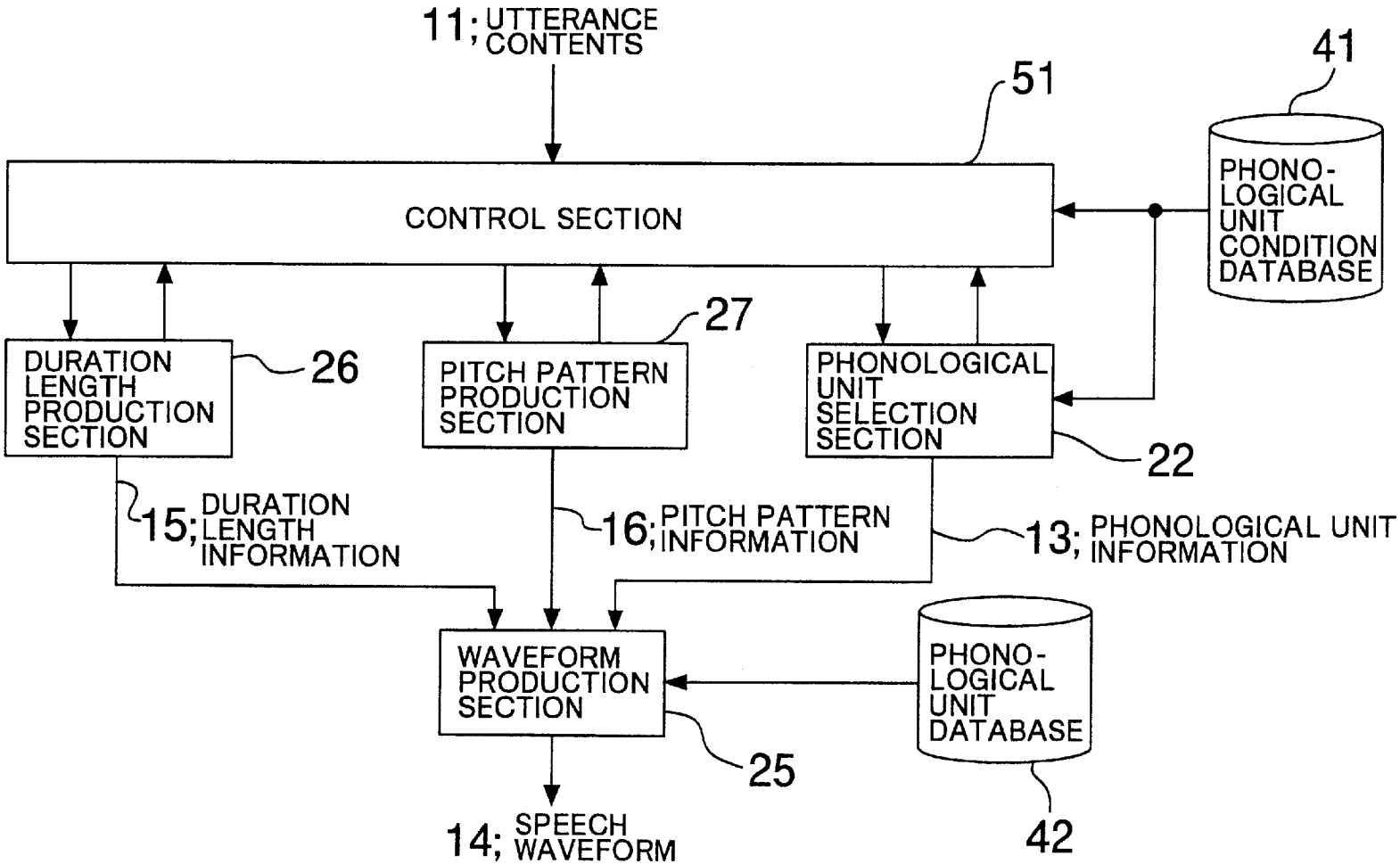

Referring now to FIG. 10, there is shown a modification to the modified speech synthesis apparatus described hereinabove with reference to FIG. 6. The present modified speech synthesis apparatus is different from the modified speech synthesis of FIG. 6 in that it does not include the prosody modification control section 23 but includes a control section 51 instead. The control section 51 receives utterance contents 11 as an input thereto and sends the utterance contents 11 to the duration length production section 26. The duration length production section 26 produces duration length information 15 based on the utterance contents 11 and sends the duration length information 15 to the control section 51.

Then, the control section 51 sends the utterance contents 11 and the duration length information 15 to the pitch pattern production section 27. The pitch pattern production section 27 produces pitch pattern information 16 based on the utterance contents 11 and the duration length information 15 and sends the pitch pattern information 16 to the control section 51.

Then, the control section 51 sends the utterance contents 11, duration length information 15 and pitch pattern information 16 to the phonological unit selection section 22, and the phonological unit selection section 22 produces phonological unit information 13 based on the utterance contents 11, duration length information 15 and pitch pattern information 16 and sends the phonological unit information 13 to the control section 51.

The control section 51 discriminates, if any of the duration length information 15, pitch pattern information 16 and phonological unit information 13 is varied, information whose modification becomes required as a result of the variation, and then sends modification contents to the pertaining one of the duration length production section 26, pitch pattern production section 27 and phonological unit selection section 22 so that suitable modification may be performed for the information. The criteria for the modification are similar to those in the speech synthesis apparatus described hereinabove.

If the control section 51 discriminates that there is no necessity for modification, then it sends the duration length information 15, pitch pattern information 16 and phonological unit information 13 to the waveform production section 25, and the waveform production section 25 produces a speech waveform 14 based on the thus received duration length information 15, pitch pattern information 16 and phonological unit information 13.

Referring now to FIG. 11, there is shown a modification to the modified speech synthesis apparatus described hereinabove with reference to FIG. 10. The present modified speech synthesis apparatus is different from the speech synthesis apparatus of FIG. 10 in that it additionally includes a shared information storage section 52.

The control section 51 instructs the duration length production section 26, pitch pattern production section 27 and phonological unit selection section 22 to produce duration length information 15, pitch pattern information 16 and phonological unit information 13, respectively. The thus produced duration length information 15, pitch pattern information 16 and phonological unit information 13 are stored into the shared information storage section 52 by the duration length production section 26, pitch pattern production section 27 and phonological unit selection section 22, respectively. Then, if the control section 51 discriminates that there is no necessity for modification any more, then the waveform production section 25 reads out the duration length information 15, pitch pattern information 16 and phonological unit information 13 from the shared information storage section 52 and produces a speech waveform 14 based on the duration length information 15, pitch pattern information 16 and phonological unit information 13.

While a preferred embodiment of the present invention has been described using specific terms, such description is for illustrative purposes only, and it is to be understood that changes and variations may be made without departing from the spirit or scope of the following claims.

What is claimed is:

1. A speech synthesis apparatus, comprising:

prosodic pattern production means for receiving utterance contents as an input thereto and producing a prosodic pattern based on the inputted utterance contents;

phonological unit selection means for selecting phonological units based on the prosodic pattern produced by said prosodic pattern production means;

prosody modification control means for searching the phonological unit information selected by said phonological unit selection means for a location for which modification to the prosodic pattern produced by said prosodic pattern production means is required and outputting, when modification is required, information of the location for the modification and contents of the modification;

prosody modification means for modifying the prosodic pattern produced by said prosodic pattern production means based on the information of the location for the modification and the contents of the modification outputted from said prosody modification control means; and waveform production means for producing synthetic speech based on the phonological unit information and the prosodic information modified by said prosody modification means.

* * * * *